US005136725A

United States Patent [19]

Montero

[11] Patent Number: 5,136,725

[45] Date of Patent: Aug. 11, 1992

[54] SPORTS GLOVE, IN PARTICULAR FOR GOALIES

[75] Inventor: Jose Montero, Lindenwasen, Fed. Rep. of Germany

[73] Assignee: Sportartikel Fabrik Karl Uhl GmbH, Balingen, Fed. Rep. of Germany

[21] Appl. No.: 598,940

[22] Filed: Oct. 17, 1990

[30] Foreign Application Priority Data

Nov. 16, 1989 [DE] Fed. Rep. of Germany ..... 3938069

[51] Int. Cl.[5] ..... A41D 19/00

[52] U.S. Cl. ..... 2/161 A; 2/167; 2/169

[58] Field of Search ..... 2/158, 159, 163, 161 R, 2/161 A, 16, 18, 167, 169

[56] References Cited

FOREIGN PATENT DOCUMENTS

| | | | |
|---|---|---|---|
| 2336006 | 1/1975 | Fed. Rep. of Germany | 2/161 A |
| 2456289 | 6/1976 | Fed. Rep. of Germany | 2/161 A |
| 2721538 | 11/1978 | Fed. Rep. of Germany | 2/161 A |
| 2807658 | 9/1979 | Fed. Rep. of Germany | 2/161 A |
| 2840197 | 3/1980 | Fed. Rep. of Germany | 2/161 A |
| 2842720 | 4/1980 | Fed. Rep. of Germany | 2/161 A |
| 2843448 | 4/1980 | Fed. Rep. of Germany | 2/161 A |
| 0045389 | 10/1989 | Japan | 2/161 A |
| 1292106 | 11/1989 | Japan | 2/161 A |
| 1596620 | 8/1981 | United Kingdom | 2/158 |

*Primary Examiner*—Werner H. Schroeder
*Assistant Examiner*—Sara M. Current
*Attorney, Agent, or Firm*—Shlesinger Arkwright & Garvey

[57] ABSTRACT

A bonding substance curing only very slowly or not at all in air is applied directly or indirectly to the outside of the palm surface of a glove, in particular a goalie glove. The bonding substance may be coated (directly). However preferably the application shall be indirect in that the bonding substance is admixed to a latex-foam layer fully or partly covering the outside of the palm surface of the glove material.

A sports glove, in particular a goalie glove so treated with a bonding substance, is characterized by high adhesion that otherwise cannot be achieved even approximately by mere coating with conventional latex foam. Catching and retaining objects, in particular those with rounded, smooth surfaces such as soccer or hand balls, can be signficantly improved as a result.

8 Claims, 2 Drawing Sheets

SPORTS GLOVE, IN PARTICULAR FOR GOALIES

DESCRIPTION

Figure 1:
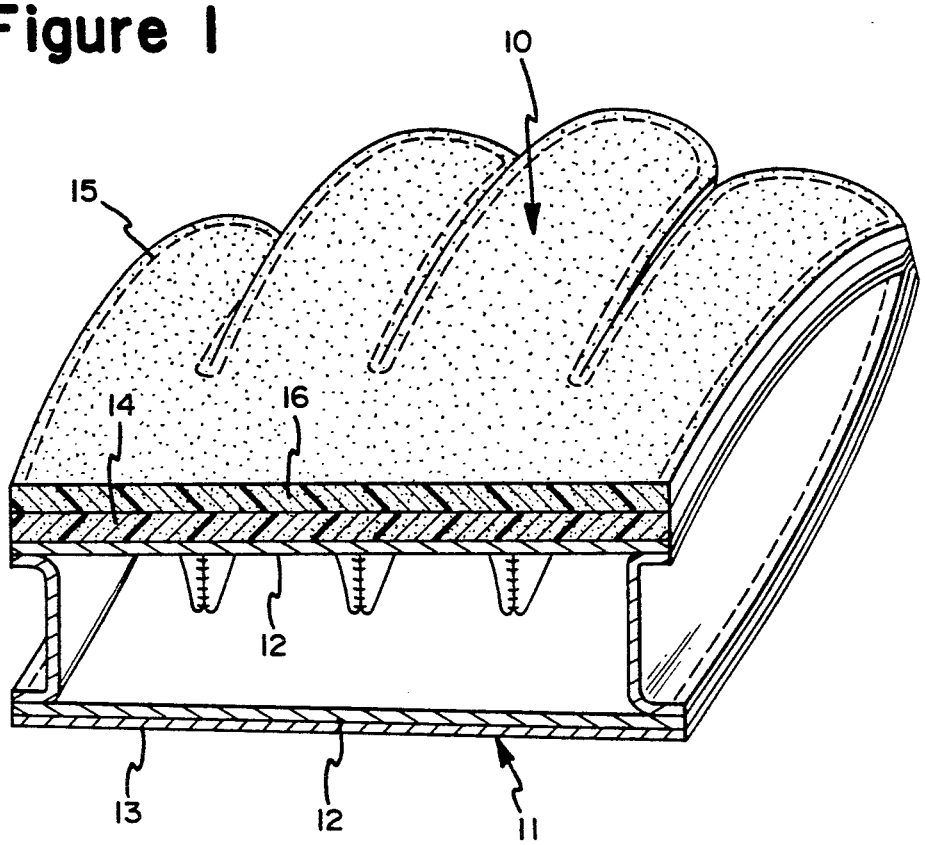

The invention concerns a sports glove, in particular for goalies.

The point in making goalie gloves as a rule is to optimize the goalie's catching reliability by the highest possible friction between the glove palm material and the ball which must be caught. It is known in this respect to coat the outside of the palm surface of the goalie glove with a foamed latex material. At the same time such a coating of foam latex on the palm provides advantageous shock absorption of the ball impact on the goalie's hands ready for catching.

However inherent limits are set by the materials on the adhesive effects which can be achieved by the steps of the state of the art. Moreover the life of conventional latex foams is limited when used on goalie, and thereby the life of the particular gloves will be similarly restricted. The mechanical stresses applied on the latex foam when making contact with the ball increasingly damage the foam surface as use continues. Moreover, because of high-frequency environmental radiation (in particular ultraviolet from sunlight), the foamed latex will increasingly cure and embrittle. Besides the already mentioned lowering of life, curing and embrittlement cause steady reduction of the adhesion, i.e. of the coefficient of friction between the latex foam and the ball surface that comes into contact with it.

The object of the invention is to further improve the adhesion of the sports glove for an object to be seized, in particular a ball to be caught, while using comparatively simple means.

This problem is solved by the invention for a sports glove, especially a goalie glove, in that a bonding substance curing not at all or only very slowly when exposed to air is applied, directly or indirectly to the outside of the palm surface.

Claim 2 contains a preferred embodiment of the invention. It was found that by admixing suitable bonding substances, it is possible to improve the inner strength of the latex foam, whereby the known operationally conditioned damages to the latex will take place only at higher stresses and then remain confined to smaller areas. By admixing bonding substances to the palm surface of the glove material, the essential advantage therefore shall be achieved to delay the aging of the latex and to substantially lower the danger of wear damage as compared to conventional latices that lack bonding materials. In particular however the invention has made it possible to achieve significantly higher friction between the glove palm surface and the seized object, for instance a ball caught by the goalie, than was possible heretofore by the material (foamed latex) of the state of the art used to coat glove palm surfaces. The high adhesion achieved by the invention by adding a bonding substance to the latex foam does on the other hand decrease with time because of surface soiling that is the result of this high adhesion. However this adhesion always may be brought back to its high initial value by washing with water, or preferably with soap lather. This reactivation can be repeated. In this manner, the original adhesion achieved by admixing a bonding substance to the latex always can be reproduced, and this even beyond the ordinary life of a goalie glove.

Whereas for conventional goalie gloves comparatively expensive natural latex foams were preferred, because of their better service life over the more economical synthetic latices otherwise equally applicable, now the admixture of the invention of suitable bonding substances allows extending the life so much that thereby even economical synthetic latex foams or mixtures of synthetic and natural latex foams are applicable to coating the palm surface of goalie gloves.

Advantageous embodiments of the invention further are stated by claims 3 and 4.

Claim 5 contains a further embodiment variation of the invention. The latex base material itself remains free of bonding substance in this embodiment mode. As a result the pores of the foamed latex base material shall not bond shut.

Obviously the thin cover coating of latex containing the bonding substance may form a closed layer on the foamed latex base material. However a preferred embodiment mode of the invention provides that the latex foam layer containing the bonding substance shall be embedded in the form of inlays or islands inside a preferably comparatively thick layer of latex foam free of bonding substance and directly covering the outside of the palm surface. In order to optimally protect against soiling or damage the latex foam mixed according to the invention a with bonding substance, further to lower the costs, these "inlays" or "islands" containing said bonding substance appropriately shall only be present in those zones of the palm surface of the glove material that meet the primary catching function. The remaining or surrounding zones of the glove palm surface on the other hand may consist of economical latex foam without bonding substance or of more abrasion-proof adhering foam of higher density. The operative zones (inlays or islands) may be projecting relative to the surrounding material for optimal operation. If the emphasis is placed on the optimal protection of the latex-foam inlays or islands containing the bonding substance, then on the other hand preferably said operative zones shall be recessed in or even flush with the surrounding material.

Regarding the particular bonding substance to be used to implement the invention, basically this invention does not place narrow limits on the expert. Experiment has shown that some bonding substances are miscible with rubber. Illustratively such mixtures are used in making adhesive tapes.

Advantageously the invention proposes that the bonding substances be pressure-sensitive adhesives preferably in the form of dispersions. Tests have shown that dispersions of pressure-sensitive adhesives of various chemical kinds can be uniformly worked into latex foams up to proportions of 50%. The invention will offer especially good results for latex foams admixed with bonding substances up to the maximum value of uniform miscibility.

Especially advantageous bonding substances were found to be dispersions based on a venylacetate/maleinate copolymer, a verylacetate/ethylene copolymer, an acrylic-acid-ester copolymer or similar copolymers preferably admixed in proportions of 20–40% by weight.

Besides the above illustration of applicable bonding substances, it is conceivable furthermore to use as bonding substances such tackifying resins based on resinic acid derivatives (based on natural resins), on terpene or petroleum (petroleum fractions) resins, which on account of their molecular structures are preferentially suited to mixing with natural latex, though being partly also suitable for mixing with synthetic latex. Illustratively resins with aromatic molecular structures are suited to be mixed into synthetic latices of aromatic structures such as based on styrene-butadiene, whereas aliphatic resins are quite miscible with natural latices evincing high-grade aliphatic structures.

A further advantageous embodiment mode of the invention calls for covering the bonding substance or the latex-foam containing the bonding material with a protective covering to be removed before using the glove. This protective covering can be a thermoplastic foil or a cover of web or of paper permitting adhesion of dust and soil and stacking of the pertinent gloves during production and delivery without the individual gloves sticking together on account of the adhering latex foam covering the palm surfaces.

Further embodiments shown in the drawing and discussed below shall be used to elucidate the invention.

FIGS. 1–4 show various embodiment modes of a goalie glove in perspective each time by means of a vertical section through the glove zone below the finger segments.

For the gloves shown, the so-called palm surface is denoted by 10 and the back of the glove (the so-called upper hand) by 11. The references 12 denotes a textile base material essentially serving as a support. The textile base material 12 is covered in the area of the "upper hand" 11 with a layer 13 consisting of a suitable material with illustratively reinforcing, water-repelling and/or shock-absorbing properties.

In the region of the palm surface 10, the textile base material 12 comprises a comparatively thick layer 14 of a foam material, which preferably is a latex foam (natural or synthetic or a mixture of both). The dashed lines 15 indicate seams joining the various glove materials.

Figure 2:
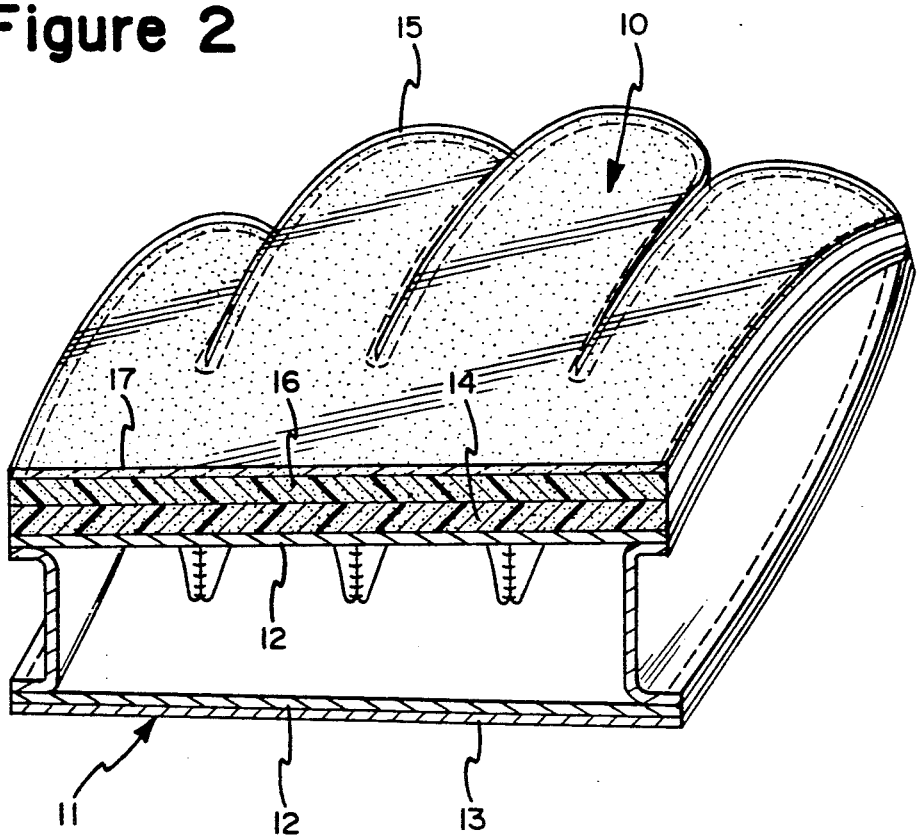

As regards the embodiment of FIGS. 1 and 2, a continuous covering layer 16 also made of latex foam is mounted in the region of the palm surface 10 on the outside of the latex base material 14. Compared to the latex base layer 14, the cover layer 16 is thin and contains a uniformly admixed bonding substance. As a result the outside of the glove palm surface 10 is endowed with adhesiveness which is advantageous when catching or holding certain objects, for instance balls.

The embodiment of FIG. 2 differs merely from that of FIG. 1 in that the latex cover layer 16 containing a bonding substance is covered by a protective layer 17 for instance in the form of a foil. The protective layer 17 is removed before the glove will be used.

Figure 3:
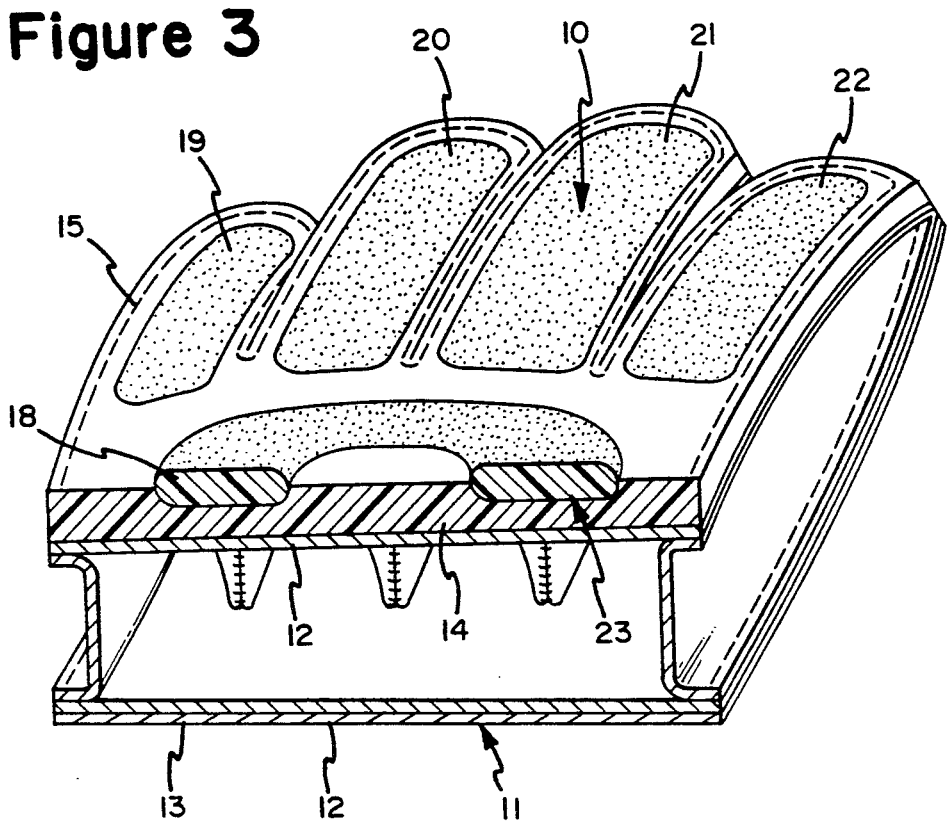

In the embodiment mode shown by FIG. 3, the base layer 14 consisting of a conventional latex foam, that is a latex foam lacking any bonding addition, is coated with a cover layer of a latex foam mixed with a bonding substance. However, contrary to the case of the embodiment modes of FIGS. 1 and 2, this cover layer is not in the form of a continuous coating, but instead in the form of individual, insular operational zones denoted in FIG. 3 by 18–22. For that purpose the latex-foam base layer 14 is embossed to be lower, for instance at 23, whereby the latex-foam operational zones 18–22 always are embedded in the manner of inlays into the latex-foam base material 14. The operational zones 18–22 may be deposited in particular as follows: the initially still unvulcanized latex substance containing the bonding substances is spread over the latex-foam base material 14 into the specifically provided pressing zones 23 in such a way that the spread latex remains in the recess 23 while being removed from the unembossed areas of the latex-foam base material 14. Thereupon the latex operational zones 18–22 containing the bonding substance are made to foam.

Figure 4:
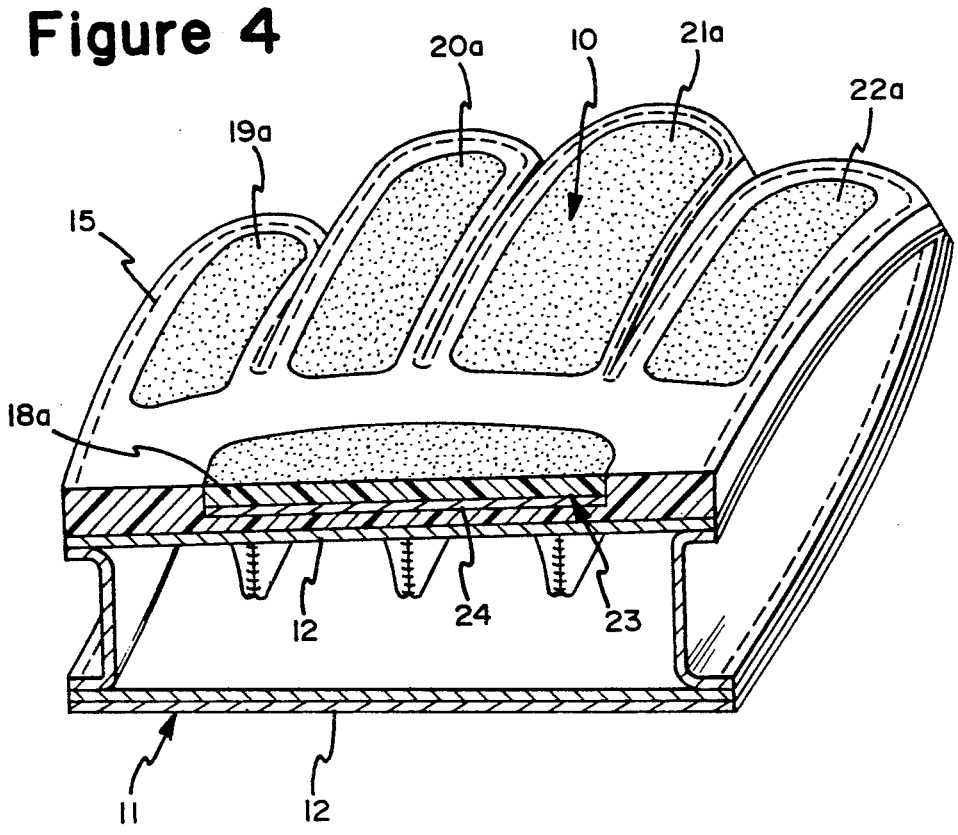

As regards the embodiment mode of FIG. 4, deep embossings 23 also are present in the individual operational zones within the latex-foam base material 14. However this embodiment differs from that disclosed in FIG. 3 in that molded parts already foamed and consisting of a latex with admixed bonding substance are inserted into the embossed recesses 23. These finished-foamed molded or operational parts each rest on a textile support 24 and, similarly to the corresponding operational components of FIG. 3, are denoted by **18*a*–22*a*. FIG. 4 further shows that the adhesive operational parts 18*a*–22*a* each are flush with the outside of the latex-foam base material 14**.

I claim:

1. A sports glove, in particular a goalie glove, comprising:

a) a palm material composed of latex foam material;

b) said palm material being treated with an adhesive; and, c) said adhesive is selected from the group consisting essentially of compounds which do not cure in air and compounds which cure very slowly over time and the adhesive is admixed with the latex foam.

2. The sports glove defined in claim 1, wherein:

a) the adhesive is homogeneously admixed with the latex foam material over its entire thickness.

3. The sports glove defined in claim 1, wherein:

a) said adhesive is admixed with a latex foam material covering a predetermined portion of the outside of the palm material.

4. The sports glove defined in claim 1 wherein:

a) said latex-foam layer containing the adhesive is present in the form of a thin, cohesive cover layer on a preferably comparatively thick latex-foam base-layer lacking any adhesive and directly covering the outside of the palm surface.

5. The sports glove defined in claim 1 wherein:

a) said latex foam material containing the adhesive is imbedded in the form of inlays or islands inside a comparatively thick latex-foam base-layer directly covering the outside of the palm surface.

6. The sports glove defined in claim 1 wherein:

a) said latex foam material containing the adhesive and covering the outside of the palm is covered again by a thin cover layer in the form of an adhesive wherein said adhesive is selected from the group consisting essentially of compounds which do not cure in air and compounds which cure very slowly over time.

7. The sports glove defined in claim 1 wherein:

a) said adhesive is a contact adhesive in emulsion form.

8. The sports glove defined in claim 1 wherein:

a) said latex foam material containing the adhesive is convered with a protective covering which can be removed before use.

* * * * *